US005646586A

United States Patent [19]

Castonguay et al.

[11] Patent Number: 5,646,586

[45] Date of Patent: Jul. 8, 1997

[54] ELECTRONIC TRIP UNIT CONVERSION KIT FOR HIGH AMPERE-RATED CIRCUIT BREAKERS

[75] Inventors: Roger N. Castonguay, Terryville; Jeffrey D. Lord, Unionville, both of Conn.

[73] Assignee: General Electric Company, New York, N.Y.

[21] Appl. No.: 551,640

[22] Filed: Nov. 1, 1995

[51] Int. Cl.[6] ..... H01H 67/02

[52] U.S. Cl. ..... 335/132; 335/202

[58] Field of Search ..... 335/132, 202, 335/177–179

[56] References Cited

U.S. PATENT DOCUMENTS 4,973,929 11/1990 Duchemin ..... 335/132

5,453,724 9/1995 Seymour et al. ..... 335/177

*Primary Examiner*—Lincoln Donovan

*Attorney, Agent, or Firm*—Richard A. Menelly; Carl B. Horton

[57] ABSTRACT

A conversion kit in the form of a flux shifter unit that interfaces with the circuit breaker operating mechanism and is installable without dismantling the circuit breaker is proposed herein. The flux shifter unit responds to the electronic trip unit to articulate the circuit breaker operating mechanism and separate the circuit breaker contacts upon occurrence of an overcurrent condition. Tolerance take-up for various manufacture's designs is achieved by expansion springs while electrical interface with remote accessories and other electronic trip units is achieved by button-actuated switches.

7 Claims, 3 Drawing Sheets

ELECTRONIC TRIP UNIT CONVERSION KIT FOR HIGH AMPERE-RATED CIRCUIT BREAKERS

BACKGROUND OF THE INVENTION

High ampere-rated circuit breakers such as described within U.S. Pat. No. 3,073,936 entitled "Electric Circuit Interrupter" are currently employed within industrial manufacturing facilities to protect the electric equipment and buildings from damage due to the occurrence of overcurrent conditions within the electrical distribution system. Earlier designs of such circuit breakers employed thermal -magnetic trip units to determine the overcurrent conditions and to articulate the circuit breaker operating mechanism to separate the circuit breaker contacts to interrupt the associated electric circuit. Later designs employed electronic trip units and employed so-called "flux shifters" to articulate the operating mechanism upon signal from the electronic trip unit. One example of an early analogue trip unit is found in U.S. Pat. No. 3,761,778 entitled "Static Trip Control Unit for Electric Circuit Breaker".

Such robust circuit breakers remain in operation to this date without needing replacement or repair. However, the advent of the digital circuit interrupters described within U.S. Pat. No. 4,672,501 entitled "Circuit Interrupter and Controller Unit", allows several circuit breakers within a common electrical distribution system to communicate with each other. It would be beneficial to convert existing circuit breakers having earlier trip units to digital trip units without having to dismantle the circuit breaker in the process.

One purpose of the invention is to provide a conversion unit that will enable circuit breakers to employ digital trip units without having to dismantle the circuit breaker operating components as well as providing electric switches on existing flux shifter trip devices to allow the operating status of the circuit breakers to be communicated.

SUMMARY OF THE INVENTION

A conversion unit contains a flux shifter unit that interfaces with a circuit breaker operating mechanism for responding to the circuit breaker electronic trip unit to articulate the circuit breaker operating mechanism and separate the circuit breaker contacts. Tolerance take-up between the flux shifter and the operating mechanism is achieved by select placement of expansion springs while electrical interface with remote accessories and other electronic trip units is achieved by button-actuated switches.

DESCRIPTION OF THE PREFERRED EMBODIMENT

Figure 1:
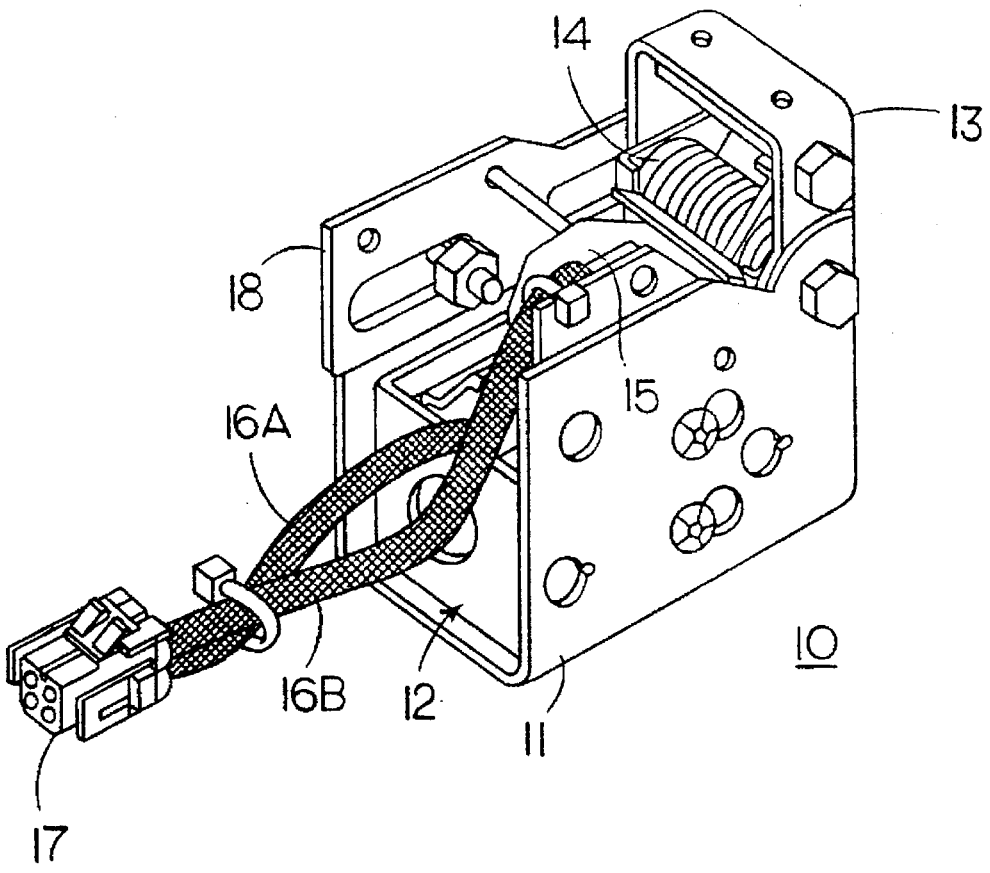
FIG. 1 is a top perspective view of a conversion unit for a high ampere-rate circuit breaker according to the invention.

The conversion unit 10 is shown in FIG. 1 to depict the arrangement of the flux shifter unit 12 relative to the U-shaped top reset lever 13, slide plate 18 and 14 within the support frame 11. Electrical power is supplied to the flux shift unit by means of electrical conductor 16A and the electrical plug 17. Upon operation of the flux shift unit, and electrical signal is transmitted over the separate conductor 16B by operation of the microswitch 15.

Figure 2:
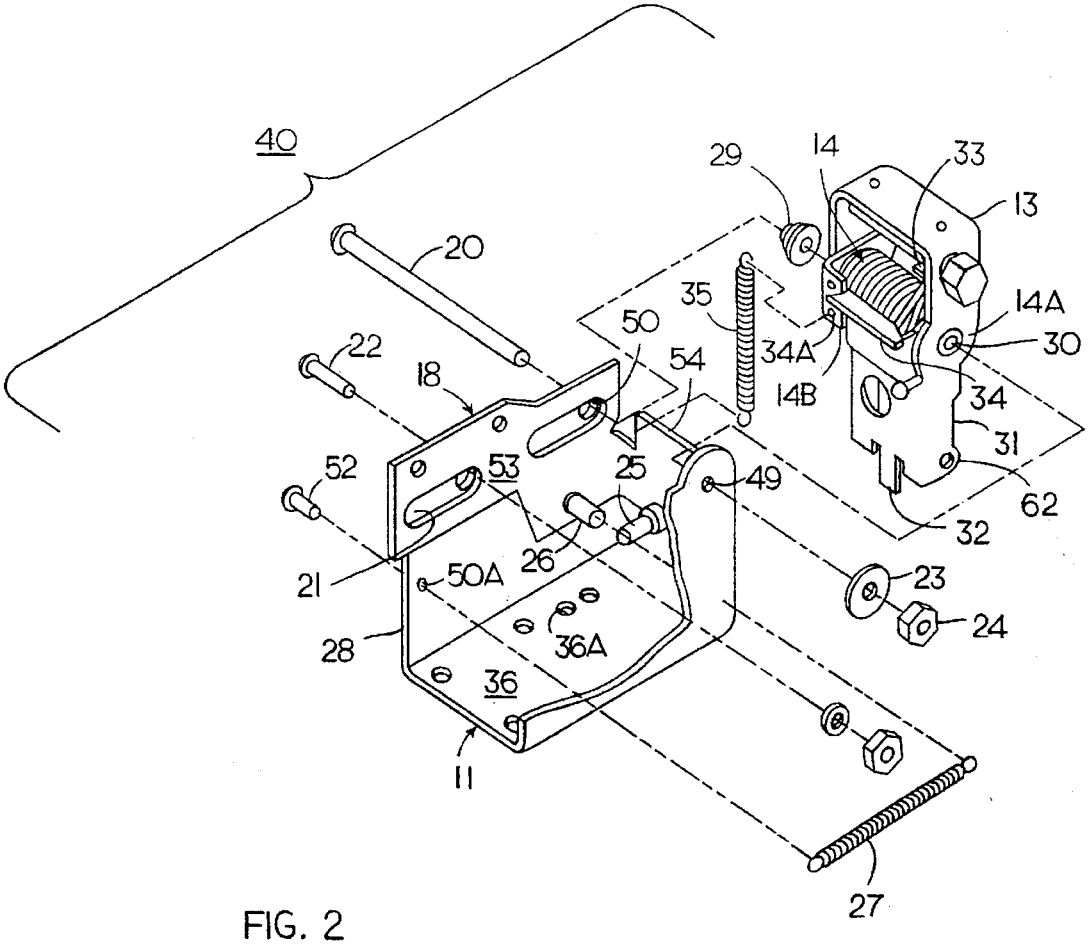
FIG. 2 is a top perspective view of the conversion unit of FIG. 1 prior to assembly of the mechanical components.

The conversion unit is first arranged as a sub-assembly 40 as best seen in FIG. 2 prior to attaching the mechanical components which include the top reset lever 13, reset spring 14, bottom reset lever 31 and the microswitch actuator plate 34, to the support frame 11. When the mechanical components are positioned on the support frame, the bottom tab 32 extending from the bottom reset lever 31 abuts the bottom 36 of the support frame with one end 14A of the coiled reset spring 14 of the abutting against the upper tab 33 of the lower reset lever 31 and the other end 14B of the reset spring abutting against a lower part of the lower reset lever as indicated. The provision of the coiled reset spring relative to the lower reset lever provides "lost motion" when an external force is applied to the lower reset lever during the resetting process to be discussed below in greater detail. The microswitch return spring 35 connects between the microswitch actuator plate and the bottom of the support frame at 34A and 36A respectively. An elongated bolt 20 extends within the spacer 29 and thru-hole 30 arranged within the upper reset lever 13 and within the reset spring 14 before attachment to the support plate by means of thru-hole 49, washer 23 and nut 24. The slide plate 18 is slidably attached to the side frame by means of the elongated slots 21 formed in the side wall 53 of the slide plate 18 and the thru-holes 50 formed in the back wall 28 of the support frame 11. The slide plate return spring 27 is attached to the back wall 28 at one end by means of the screw 52 and thru-hole 50 and to the slide plate 18 by means of the post 26 extending from the slide plate. The post 25 extending from the front wall 54 of the slide plate interacts with the armature 19 on the flux shifter 12 as shown in FIG. 3.

Figure 3:
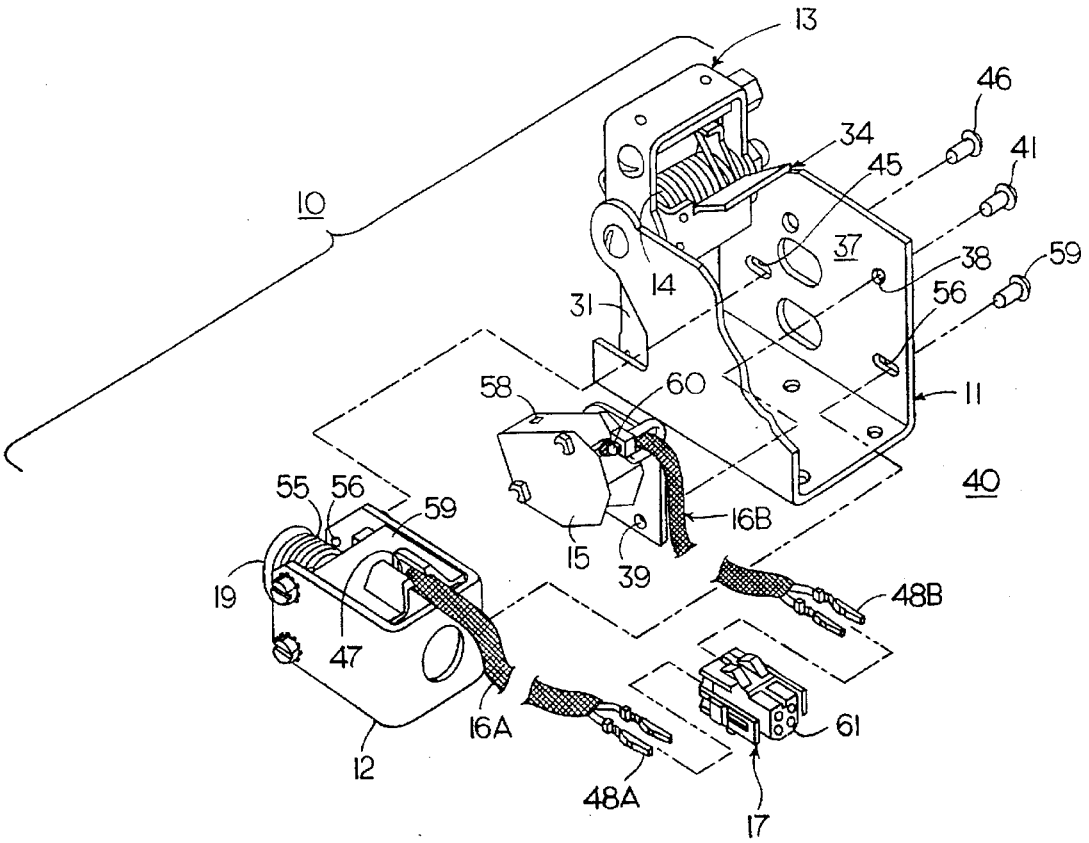
FIG. 3 is a top perspective view of the conversion unit of FIG. 2 prior to assembly of the electrical components.

The subassembly 40 in FIG. 3 in the form of the support frame 11 with the mechanical components in the form of the top reset lever 13, reset spring 14, lower reset lever 31 and microswitch plate 34 attached is next fitted with the electrical components consisting of the flux shifter unit 12 and the microswitch 15. The flux shifter unit 12 is attached to the front wall 37 of the support frame by means of thru-holes 45, 56 in the support frame and flux shifter unit respectively and the screws 46, 41. The microswitch 15 is attached to the front wall 37 above the flux shifter unit 12 and in abutment with the bottom surface of the microswitch plate 34 by means of the thru-holes 38, 39 in the support frame and microswitch respectively and the screws 57. The flux shifter unit 12 is arranged with the armature 19 in the quiescent position against the stored bias of the compression spring 55. As described in the aforementioned U.S. Pat. No. 3,761,778, the application of a voltage signal to the flux shifter unit over conductors 16A counters the holding flux provided by the permanent magnet to propel the armature against the trip bar of the associated circuit breaker operating mechanism (not shown). One end of the electrical conductors 16A connect with the flux shifter unit as indicated at 47 and the other end terminates in a pair of plugs 48A that are received in one end of the electrical plug 17. One end of the electrical connectors 16B connect with the microswitch 15 as indicated at 60 and the other end terminates in a pair of plugs 48B that are received in the one end of the electrical plug 17. The receptacles 61 at the opposite end of the electrical plug connects with the circuit breaker trip unit (not shown) which is described in the aforementioned U.S. Pat. No. 3,761,778. With the conversion kit 10 fully assembled, as shown in FIG. 1, the operation is best understood by referring to FIGS. 1–3 conjointly.

Upon receipt of a control signal over conductor 16A, the flux shifter unit 12 within the conversion kit 10 releases the armature 19 under the urgency of the compression spring 55 to articulate the associated circuit breaker operating mechanism and interrupt the electric circuit. The armature contacts the bottom reset lever 31 which rotates the top reset lever 13 away from the microswitch plate 34, which moves away from the microswitch button allowing transfer of a signal over conductors 16B and electrical plug 17 to remote indicators connected with the electrical plug that a circuit interruption has occurred. The slide plate becomes extended as indicated in phantom in FIG. 1 upon contact between the armature 19 and the post 25, and remains extended against the bias provided by the return spring 27. The microswitch plate 34 also remains away from the microswitch button 58 against the bias of the extended microswitch spring 35. An important feature of the invention is the ability to reset the conversion kit by simply applying a force to the bottom reset lever in the indicated direction. Although not shown, for purposes of clarity, an extended lever or cable is attached to the bottom reset lever by attachment to the thru-hole 62 for remote operation. The armature 19 remains extended until the conversion kit is reset by operation of the rotation of the bottom reset lever 31 thereby providing a force to overcome the holding bias of the extended compression spring 55. The return of the compression spring to its quiescent position allows the return spring 27 to return the slide plate 18 and the microswitch spring 35 to return the microswitch plate to their rest positions as shown in FIG. 1. Another important feature of the invention is the provision of the reset spring 14 intermediate the top and bottom reset levers 13, 31 for the purpose of providing tolerance between the amount of force exerted on the bottom reset lever during the reset operation.

Accordingly, a conversion kit has herein been described that allows an electronic trip unit to interact with a variety of circuit breaker operating mechanisms. The mechanical components are arranged for wide tolerance between the various circuit breaker designs to prevent damage to both the mechanical as well as the electrical components therein.

We claim:

1. A conversion kit for circuit breaker electronic trip units comprising:

a support frame;

a flux shifter unit having an extendible armature and attached to said support frame;

a slide plate movably attached to said support frame and arranged for interacting with said armature;

a first reset lever rotatably mounted on said support frame for returning said armature from an extended position to a retracted position;

a slide plate return spring attached between said slide plate and said support frame for moving said slide plate from an extended to a retracted position;

a second reset lever subjacent said first reset lever, said second reset lever being arranged for connection with a reset arm for manual resetting of said flux shifter unit and means for electrically connecting said flux shifter unit to a remote electronic trip unit.

2. The conversion kit of claim 1 including a coiled spring arranged between a top part and a bottom part of said second reset lever for providing lost motion tolerance to said second reset lever.

3. The conversion kit of claim 1 further including an electric switch and an electric switch plate proximate said first reset lever whereby said first reset lever actuates said electric switch plate into and of contact with a button on said electric switch.

4. The conversion kit of claim 3 including an electric switch plate return spring connecting between said electric switch plate and said support frame to return said electric switch plate into contact with said switch button.

5. The conversion kit of claim 1 wherein said slide plate defines a side wall and a front wall, said front wall extending at an angle to said side wall.

6. The conversion kit of claim 5 including an armature post extending from a rear of said front wall, said armature post providing means for receiving said armature when said armature is in an extended position.

7. The conversion kit of claim 5 wherein said slide plate side wall includes an elongated slot receiving bolts attached to said support frame for slidably retaining said slide plate on said support frame.

* * * * *